US007768181B2

(12) United States Patent
Baik et al.

(10) Patent No.: US 7,768,181 B2
(45) Date of Patent: Aug. 3, 2010

(54) ELECTRON MULTIPLIER ELECTRODE AND TERAHERTZ RADIATION SOURCE USING THE SAME

(75) Inventors: Chan-wook Baik, Seongnam-si (KR); Yong-wan Jin, Seoul (KR); Sun-il Kim, Seoul (KR); Min-jong Bae, Yongin-si (KR)

(73) Assignee: Samsung Electronics, Co., Ltd., Gyeonggi-do (KR)

( * ) Notice: Subject to any disclaimer, the term of this patent is extended or adjusted under 35 U.S.C. 154(b) by 193 days.

(21) Appl. No.: 12/007,186

(22) Filed: Jan. 8, 2008

(65) Prior Publication Data

US 2008/0164798 A1 Jul. 10, 2008

(30) Foreign Application Priority Data

Jan. 8, 2007 (KR) ..... 10-2007-0002168

(51) Int. Cl.
*H01J 1/62* (2006.01)

(52) U.S. Cl. ..... 313/103 R; 313/103 CM; 313/495

(58) Field of Classification Search ..... 313/495, 313/103 R, 103 CM, 104
See application file for complete search history.

(56) References Cited

U.S. PATENT DOCUMENTS

2007/0075240 A1* 4/2007 Hieke ..... 250/282

* cited by examiner

*Primary Examiner*—Vip Patel
(74) *Attorney, Agent, or Firm*—Harness, Dickey & Pierce, P.L.C.

(57) ABSTRACT

Provided are an electron multiplier electrode using a secondary electron extraction electrode and a terahertz radiation source using the electron multiplier electrode. The electron multiplier electrode includes: a cathode; an emitter disposed on the cathode and extracting electron beams; a gate electrode for switching the electron beams, the gate electrode being disposed on the cathode to surround the emitter; and a secondary electron extraction electrode disposed on the gate electrode and including a secondary electron extraction layer extracting secondary electrons due to collision of the electron beams.

19 Claims, 5 Drawing Sheets

ELECTRON MULTIPLIER ELECTRODE AND TERAHERTZ RADIATION SOURCE USING THE SAME

CROSS-REFERENCE TO RELATED PATENT APPLICATION

This application claims the benefit of Korean Patent Application No. 10-2007-0002168, filed on Jan. 8, 2007, in the Korean Intellectual Property Office, the disclosure of which is incorporated herein in its entirety by reference.

BACKGROUND OF THE INVENTION

1. Field of the Invention

The present invention relates to an electron multiplier electrode and a terahertz radiation source using the electron multiplier electrode, and more particularly, to an electron multiplier electrode using a secondary electron extraction electrode and a terahertz radiation source using the electron multiplier electrode.

2. Description of the Related Art

A bandwidth of $10^{12}$ Hz has become important in application fields such as molecular optics, biophysics, medicine, spectroscopy, image processing and security. However, despite the importance of the bandwidth of $10^{12}$ Hz, terahertz radiation sources or multipliers have not yet been developed due to physical and engineering limits. Recently, terahertz radiation sources or multipliers have been actively developed and various methods have been attempted in order to develop terahertz radiation sources since various new relevant concepts and micromachining technologies have been developed.

FIG. 1 is a schematic view of such a conventional terahertz radiation source that has been developed. Referring to FIG. 1, the conventional terahertz radiation source includes: a substrate 1; an emitter 2 and an anode 6 that are disposed on the substrate 1 and face each other; and electron lenses 3, electron beam deflectors 4 and metal lattices 5 which are disposed between the emitter 2 and the anode 6. In this structure, while a path of an electron beam 8 is being adjusted by the electron lenses 3 and the electron beam deflectors 4, an electron beam 8 emitted from the emitter 2 proceeds towards the anode 6. During operation, the electron beam 8 passes by the metal lattices 5 which are disposed at regular intervals. At this time, terahertz electromagnetic waves 7 are generated due to the smith-purcell effect. The frequency of the electromagnetic waves 7 generated can be controlled by an interval between the metal lattices 5.

Meanwhile, as a structure for generating terahertz electromagnetic waves from an electron beam, photonic band gap crystals, cavity resonators and waveguide structures are known in addition to the above described smith-purcell radiation structure using the metal lattices 5.

However, in the case of the terahertz radiation source having the above described structure, since a current of the electron beam is very small when the size of the terahertz radiation source is small, it is not easy to radiate or amplify electromagnetic waves having a bandwidth of $10^{12}$ Hz. In terms of efficiency, an emission current emitted from an emitter should be very great and current density should be great as well, but in this state the lifetime of the emitter decreases.

Currently, technologies for solving this problem have been suggested using an electron multiplier microchannel plate. FIG. 2A is a view of a field emission circuit using an electron multiplier. Referring to FIG. 2A, the field emission circuit is configured in a structure in which an electron multiplier 14 is disposed between a cathode 11 and an anode 13, and an emitter 12, which is formed of a carbon nanotube (CNT), is disposed on the cathode 11. In this case, compared with a circuit of FIG. 2B in which the electron multiplier 14 is not disposed, it has been noted that the current of the electron beam reaching the anode 13 is about 7.5 times higher in the case of the circuit of FIG. 2A.

FIG. 3 is a schematic view of a conventional electron multiplier. Referring to FIG. 3, the conventional electron multiplier includes an insulating substrate 23 having a shape of a looped-type disk, upper and lower electrodes 24 and 25 that are respectively formed on upper and lower surfaces of the insulating substrate 23, a resistance layer 26 formed on an inner surface 23*a* of the insulating substrate 23, and a secondary electron extraction electrode 27 formed on the resistance layer 26. The secondary electron extraction electrode 27 may be formed of an oxide (e.g., MgO, $SiO_2$ and $La_2O_3$) or a fluoride ($CaF_2$ and $MgF_2$) having a large secondary electron coefficient.

In such a structure, when a voltage is applied between the upper and lower electrodes 24 and 25, the electron beam incident in a hole 28 of the insulating substrate 23 collides with the secondary electron extraction electrode 27, and then the electron beam is accelerated and emitted from the hole 28 together with a secondary electron due to a potential difference between the upper and lower electrodes 24 and 25.

In the case of the electron multiplier having the above structure, in order to maximize extraction of the secondary electrons, a high voltage should be applied between the upper and lower electrodes 24 and 25. In this case, a current flows along the resistance layer 26 having a resistance of several MΩ. Accordingly, breakdown is likely to occur between the upper and lower electrodes 24 and 25 due to the high voltage. In addition, due to the current flowing along the resistance layer 26, a final electron extraction current can not be greater than the current of the resistance layer 26. Due to the current flowing along the resistance layer 26, heat problems or physical damage can also occur.

SUMMARY OF THE INVENTION

The present invention provides an electron multiplier electrode that maintains the advantages of a conventional electron multiplier having increased lifetime by lowering a current of an emitter, and easies secondary electron extraction and can focus an electron beam while removing disadvantages of conventional electron multipliers.

According to an aspect of the present invention, there is provided an electron multiplier electrode including: a cathode; an emitter disposed on the cathode and extraction electron beams; a gate electrode for switching the electron beams, which is disposed on the cathode to surround the emitter; and a secondary electron emitting electrode disposed on the gate electrode and comprising a secondary electron extraction layer extracting secondary electrons due to collision of the electron beams.

A plurality of secondary electron extraction electrodes having the same structure may be consecutively arranged in a proceeding direction of the electron beams.

The gate electrode and the secondary electron extraction electrode may each have a shape of looped-type disk comprising a hole formed in a center-portion of each of the gate electrode and the secondary electron extraction electrode.

The secondary electron extraction layer may be coated on an entire surface of the secondary electron extraction electrode.

The secondary electron extraction layer may be coated on an inner surface of the hole of the secondary electron extraction electrode having the shape of the looped-type disk.

An insulating layer may be interposed between the cathode and the gate electrode, between the gate and the secondary electron extraction electrode, and between adjacent ones of the plurality of secondary electron extraction electrodes.

The emitter may be formed of a dispenser cathode material emitting thermoelectrons, a field emission type spindt cathode material having conical shape emitting cold electrons, a CNT (carbon nanotube) or ZnO.

Voltages applied to the cathode, the gate electrode and the secondary electron extraction electrode may be respectively denoted by Vc, Vg and Ve, and an equation $Vc<Vg<Ve$ is satisfied.

According to another aspect of the present invention, there is provided a tera hertz radiation source including: a cathode; an emitter disposed on the cathode and emitting electron beams; a gate electrode for switching the electron beams, which is disposed on the cathode to surround the emitter; a secondary electron extraction electrode disposed on the gate electrode and comprising a secondary electron extraction layer extracting secondary electrons due to collision of the electron beams; an anode facing the secondary electron extraction electrode and receiving the electron beams; and a terahertz circuit disposed between the anode and the secondary electron extraction electrode and generating terahertz electromagnetic waves using the electron beams.

Voltages applied to the cathode, the gate electrode, the secondary electron extraction electrode and the anode may be respectively denoted by Vc, Vg, Ve and Va, and an equation $Vc<Vg<Ve<Va$ is satisfied.

A voltage applied to each of the plurality of secondary electron extraction electrodes, which are consecutively arranged, may increase along a proceeding direction of the electron beams.

The terahertz circuit may be any one of a smith-purcell radiation structure, a photonic band gap crystal structure, a cavity resonator structure and a waveguide structure.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 4:
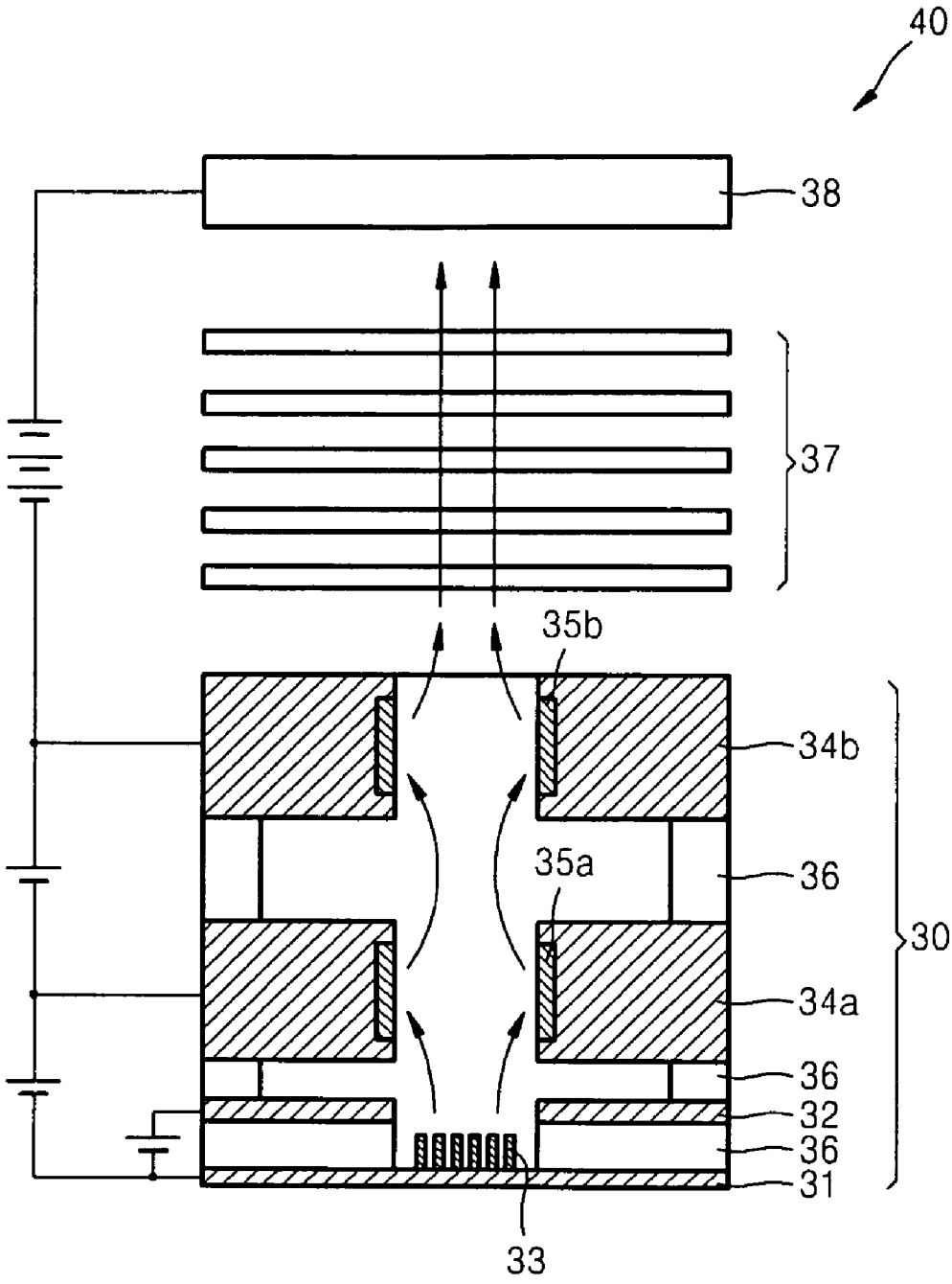
FIG. 4 is a schematic cross-sectional view illustrating an electron multiplier electrode and a terahertz radiation source using the same, according to an embodiment of the present invention.

FIG. 4 is a schematic cross-sectional view illustrating an electron multiplier electrode 30 and a terahertz radiation source 40 using the same, according to an embodiment of the present invention.

Referring to FIG. 4, the electron multiplier electrode 30 includes a cathode 31, an emitter 33 disposed on the cathode 31 and emitting electron beams, a gate electrode 32 disposed on the cathode 31 to surround the emitter 33 and first and second secondary electron extraction electrodes 34*a* and 34*b* consecutively disposed on the gate electrode 32. The gate electrode 32 and the first and second secondary electron extraction electrodes 34*a* and 34*b* are shown as if they are arranged to be symmetric, with a proceeding path of the electron beams in FIG. 4 acting as a line of symmetry. However, the real shape of each of the gate electrode 32 and the first and second secondary electron extraction electrodes 34*a* and 34*b* is a looped-type disk including a hole formed in a center-portion of each of the gate electrode 32 and the first and second secondary electron extraction electrodes 34*a* and 34*b*. That is, the gate electrode 32 and the first and second secondary electron extraction electrodes 34*a* and 34*b* are configured to surround the path of the electron beams emitted from the emitter 33.

The emitter 33 emitting the electron beams is formed having sharp needle shapes so as to easily emit electrons. To achieve this, the emitter 33 may be formed of a dispenser cathode material (e.g., porous tungsten, barium oxide (BaO), barium strontium oxide (BaSrO), calcium oxide (CaO), aluminum oxide ($Al_2O_3$) or $LaB_6$) emitting thermoelectrons, molybdenum that is a field emission type spindt cathode material having conical shape emitting cold electrons, a carbon-based material (e.g., carbon nanotube (CNT) and diamond like carbon (DLC)) or ZnO. In particular, the emitter 33 formed of CNT is widely used. The gate electrode 32 surrounding the emitter 33 functions as a switch by which electron beam emission of the emitter 33 is switched on and off. That is, when a voltage is applied to the gate electrode 32, the electron beams are emitted from the emitter 33. When a voltage is not applied to the gate electrode 32, the electron beams are not emitted from the emitter 33.

The first and second secondary electron extraction electrodes 34*a* and 34*b* emit secondary electrons, and simultaneously function to focus and accelerate the electron beams. To achieve this, as illustrated in FIG. 4, the first and second secondary electron extraction electrodes 34*a* and 34*b* include secondary electron extraction layers 35*a* and 35*b* extracting secondary electrons due to collisions with the electron beams. As known in a conventional electron multiplier, the secondary electron extraction layer 35*a* and 35*b* may be formed of an oxide (MgO, $SiO_2$ and $La_2O_3$) or a fluoride ($CaF_2$ and $MgF_2$) having a great secondary electron coefficient. The secondary electron extraction layer 35*a* and 35*b* is illustrated to be coated only on an inner surface of a hole of the first and second secondary electron extraction electrodes 34*a* and 34*b* having a shape of a looped-type disk in FIG. 4. However, the secondary electron extraction layer 35*a* and 35*b* may be coated on entire surfaces of the first and second secondary electron extraction electrodes 34*a* and 34*b*.

Two first and second secondary electron extraction electrodes 34*a* and 34*b* are exemplarily illustrated in FIG. 4.

However, three secondary electron extraction electrodes or more having the same structures may be consecutively arranged along preceding paths of the electron beams in order to increase a current of the electron beams. In addition, only one secondary electron extracting electrode may be used. The number of the used secondary electron extraction electrode may be selected according to a necessary current of the electron beams.

In addition, since a voltage is applied to each of the cathode 31, the gate electrode 32, and the first and second secondary electron extraction electrodes 34*a* and 34*b* in the electron multiplier electrode 30, an insulating layer 36 is disposed between adjacent ones of the cathode 31, the gate electrode 32, and the first and second secondary electron extraction electrodes 34*a* and 34*b* in order to prevent short circuiting. That is, a insulating layer 36 is disposed between the cathode 31 and the gate electrode 32, between the gate electrode 32 and the first secondary electron extraction electrode, and between the first secondary electron extraction electrode 34*a* and the second secondary electron extraction electrode 34*b*.

Figure 1:
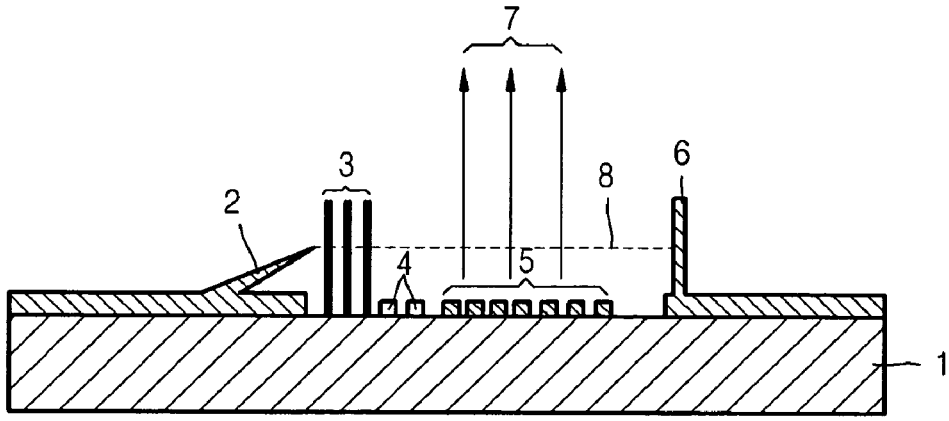
FIG. 1 (RELATED ART)
FIG. 1 is a schematic view of a conventional terahertz radiation source.
Figure 2A:
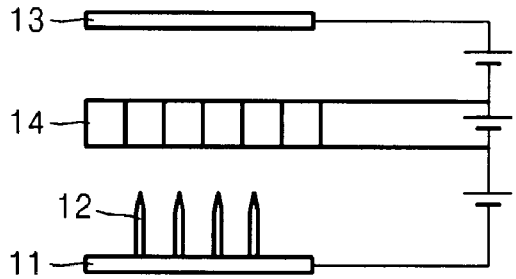
FIG. 2A (RELATED ART)
FIG. 2A is a view of a field emission circuit using an electron multiplier.
Figure 2B:
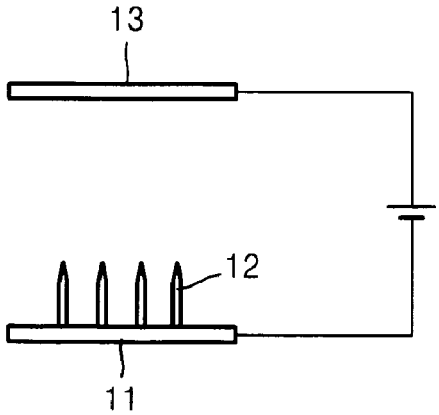
FIG. 2B (RELATED ART)
FIG. 2B is a view of a field emission circuit having no electron multiplier.
Figure 3:
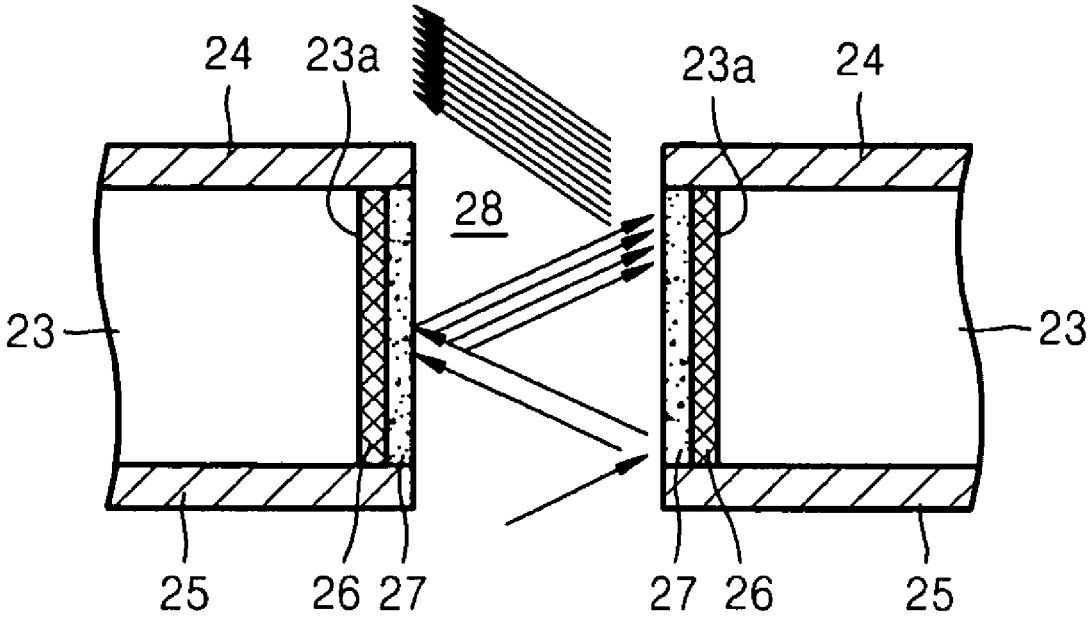
FIG. 3 (RELATED ART)
FIG. 3 is a schematic view of a conventional electron multiplier.

Meanwhile, in addition to the electron multiplier electrode 30, the terahertz radiation source 40 further includes an anode 38 facing the electron multiplier electrode 30 having the above shape, and a terahertz circuit 37 disposed between the electron multiplier electrode 30 and the anode 38. In FIG. 4, the anode 38 faces the second secondary electron extraction electrode 34*b*, and receives the electron beams emitted through the second secondary electron extraction electrode 34*b*. The terahertz circuit 37 generates terahertz electromagnetic waves using the electron beams. A smith-purcell radiation structure using a metal lattice illustrated in FIG. 1. may be used as the terahertz circuit 37. As described above, a photonic band gap crystal structure, a cavity resonator structure or a waveguide structure may be also used as the terahertz circuit 37. The terahertz circuit 37 having the above structure generates terahertz electromagnetic waves having a predetermined wavelength by resonating energy of the electron beams.

Hereinafter, operations of the electron multiplier electrode 30 and the terahertz radiation source 40 will be described.

First, a voltage is applied to each of the cathode 31, the gate electrode 32, the first and second secondary electron extraction electrodes 34*a* and 34*b* and the anode 38. Then, the electron beams are emitted from the emitter 33 to proceed towards the anode 38. The voltage applied to each electrode increases along a proceeding direction of the electron beams in order to accelerate the electron beams. For example, when voltages applied to the cathode 31, the gate electrode 32, the first secondary electron extraction electrode 34*a*, the second secondary electron extraction electrode 34*b* and the anode 38 are respectively denoted by Vc, Vg, Ve1, Ve2 and Va, an equation $Vc<Vg<Ve1<Ve2<Va$ may be satisfied. When at least three secondary electron extraction electrodes are consecutively arranged, the voltage applied to a plurality secondary electron extraction electrodes consecutively arranged may increase along the proceeding direction of the electron beams.

Figure 5:
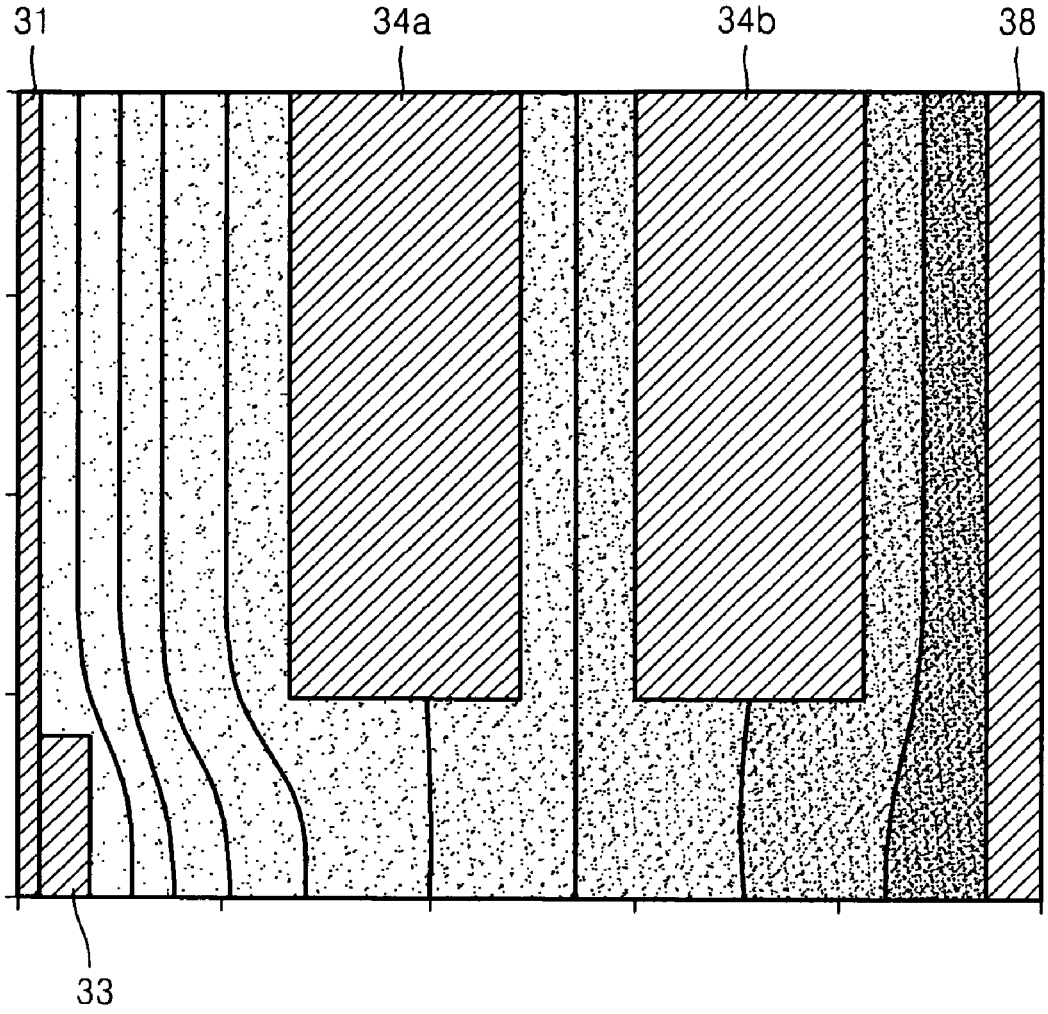
FIG. 5 is a view illustrating the potential distribution of the terahertz radiation source illustrated in FIG. 4.

FIG. 5 is a view illustrating the potential distribution of the terahertz radiation source 40 illustrated in FIG. 4. Referring to FIG. 5, the potential distribution lines around the emitter 33 and the anode 38 are formed to have a lens-shape. This is illustrated by the curvature of the equi-potential. The potential distribution lines around the first and second secondary electron extraction electrodes 34*a* and 34*b* are formed to be parallel to one another. In addition, the potential is gradually increased towards the anode 38. Therefore, according to the present invention, by applying an appropriate voltage to the first and second secondary electron extraction electrodes 34*a* and 34*b*, the electron beams emitted from the emitter 33 can be accelerated towards the anode 38 and can be simultaneously focused.

Meanwhile, while the electron beams emitted from the emitter 33 proceed towards the anode 38, a part of the electron beams collide with the first secondary electron extraction electrode 34*a*. Then, secondary electrons are extracted from the first secondary electron extraction layer 35*a* coated on the first secondary electron extraction electrode 34*a*. The secondary electrons generated like this are accelerated by the second secondary electron extraction electrode 34*b* to proceed towards the anode 38. When a part of the secondary electrons and a part of the electron beams emitted from the emitter 33 collide with the second secondary electron extraction electrode 34*b*, secondary electrons are additionally emitted from the secondary electron extraction layer 35*b* coated on the second secondary electron extraction electrode 34*b*. On the other hand, a part of the electron beams proceeding around the central axis do not collide with the first and second secondary electron extraction electrodes 34*a* and 34*b*, and pass through the electron multiplier electrode 30.

Figure 6:
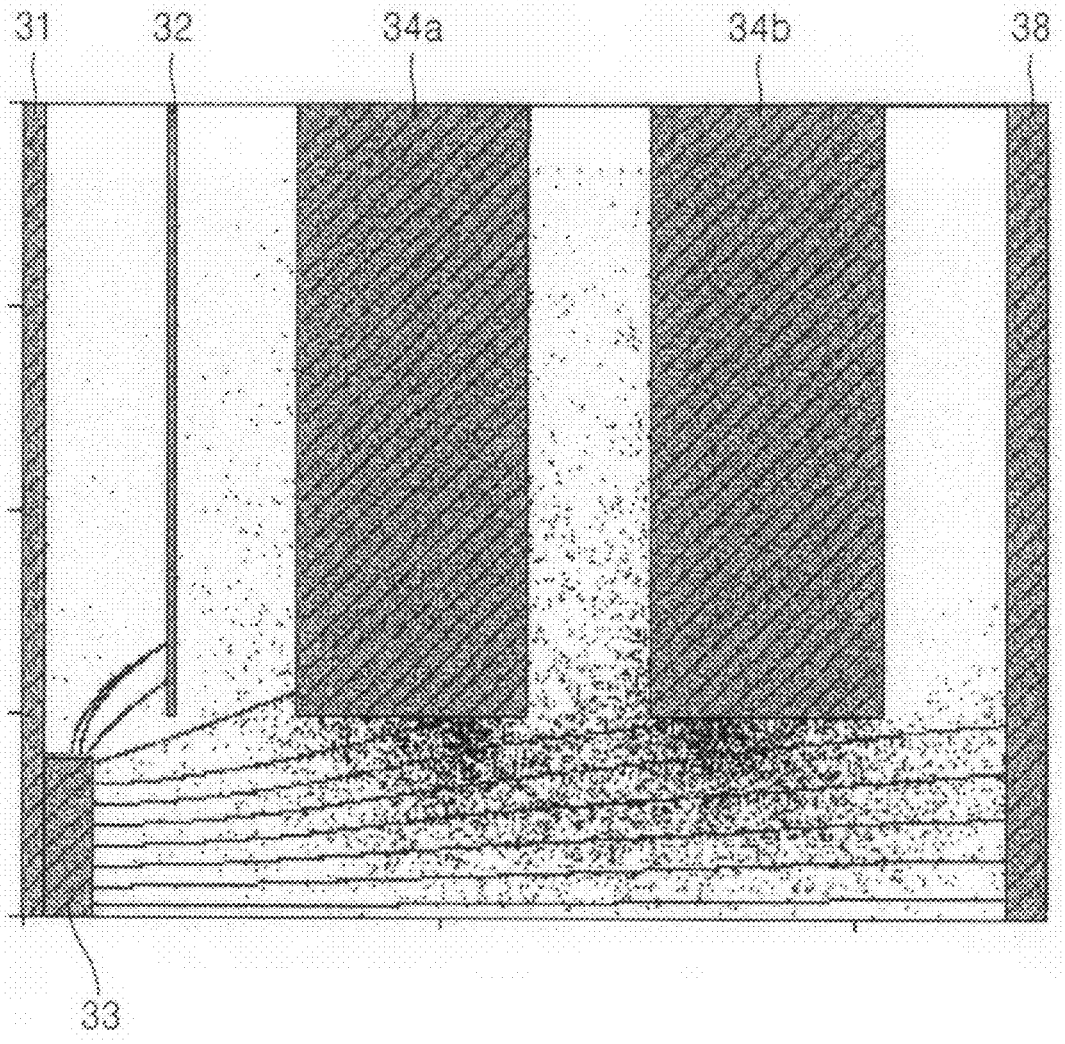
FIG. 6 is a view illustrating paths of the electron beams and the distribution of the electron emission in the terahertz radiation source illustrated in FIG. 4.

FIG. 6 is a view illustrating paths-of the electron beams and the distribution of the electron emission in the terahertz radiation source 40. In FIG. 6, it is assumed that the secondary electron extraction layers 35*a* and 35*b* are coated on entire surfaces of the secondary electron extraction electrodes 34*a* and 34*b*. The paths of the electron beams are indicated as solid lines and the secondary electrons generated by the secondary electron extraction layers 35*a* and 35*b* are illustrated as dots. As illustrated in FIG. 6, a part of the electron beams emitted from the emitter 33 is absorbed in the gate electrode 32. Most of the electron beams proceed towards the anode 38. A part of the electron beams proceeding towards the anode 38 collide with the first and second secondary electron extraction electrodes 34*a* and 34*b* to generate the secondary electrons. Another part of the electron beams proceeding towards the anode 38 is absorbed in the anode 38 without collision.

The electron beams, which are multiplied, accelerated and focused using this manner by the electron multiplier electrode 30, may have much great current density of about 10 $A/cm^2$. Accordingly, when the electron beams pass out of the electron multiplier electrode 30 and passes by the terahertz circuit 37, the terahertz circuit 37 can emit terahertz electromagnetic waves having a high enough intensity.

In the case of the electron multiplier electrode according to the present invention, since a secondary electron extraction layer is not formed on a resistance layer on which a current flows, secondary electrons can be emitted without loss. Accordingly, the emission efficiency of secondary electron can be increased, and electron beams having higher current density can be generated, compared with the conventional art. In addition, thermal problems and insulating breaking due to the current flowing on the resistance layer do not occur in the electron multiplier electrode according to the present invention.

According to the present invention, since the current of an emitter can be maintained to be relatively small, the lifetime of the emitter, formed of a material such as CNT, is increased.

In addition, since the electron multiplier electrode according to the present invention generates secondary electrons, and simultaneously accelerates and focuses electron beams, additional means are not required for accelerating and focusing electron beams.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electron multiplier comprising:

a cathode;

an emitter disposed on the cathode and emitting electron beams;

a gate electrode for switching the electron beams, which is disposed on the cathode to surround the emitter;

a secondary electron extraction electrode disposed on the gate electrode; and a secondary electron extraction layer extracting secondary electrons due to collision of the electron beams, wherein the secondary electron extraction layer is directly coated at least on an inner surface of a hole of the secondary electron extraction electrode having the shape of the looped-type disk.

2. The electron multiplier electrode of claim 1, wherein a plurality of secondary electron extraction electrodes having the same structure are consecutively arranged in a proceeding direction of the electron beams.

3. The electron multiplier electrode of claim 1, wherein the gate electrode and the secondary electron extraction electrode each have a shape of looped-type disk comprising a hole formed in a center-portion of each of the gate electrode and the secondary electron extraction electrode.

4. The electron multiplier electrode of claim 3, wherein the secondary electron extraction layer is coated on an entire surface of the secondary electron extraction electrode.

5. The electron multiplier electrode of claim 3, wherein the secondary electron extraction layer is coated on an inner surface of the hole of the secondary electron extraction electrode having the shape of the looped-type disk.

6. The electron multiplier electrode of claim 1, wherein an insulating layer is interposed between the cathode and the gate electrode, and between the gate electrode and the secondary electron extraction electrode.

7. The electron multiplier electrode of claim 2, wherein an insulating layer is interposed between the cathode and the gate electrode, between the gate and the secondary electron extraction electrode, and between adjacent ones of the plurality of secondary electron extraction electrodes.

8. The electron multiplier electrode of claim 1, wherein the emitter is formed of a dispenser cathode material emitting thermoelectrons, a field emission type spindt cathode material having conical shape emitting cold electrons, a CNT (carbon nanotube) or ZnO.

9. The electron multiplier electrode of claim 1, wherein voltages applied to the cathode, the gate electrode and the secondary electron extraction electrode are respectively denoted by Vc, Vg and Ve, and an equation $Vc<Vg<Ve$ is satisfied.

10. A terahertz radiation source comprising:

the electron multiplier electrode of claim 1;

an anode facing the secondary electron extraction electrode and receiving the electron beams; and a terahertz circuit disposed between the anode and the secondary electron extraction electrode and generating terahertz electromagnetic waves using the electron beams.

11. The terahertz radiation source of claim 10, wherein a plurality of secondary electron extraction electrodes having the same structure are consecutively arranged in a proceeding direction of the electron beams.

12. The terahertz radiation source of claim 10, wherein the gate electrode and the secondary electron extraction electrode each have a shape of looped-type disk comprising a hole formed in a center-portion of each of the gate electrode and the secondary electron extraction electrode.

13. The terahertz radiation source of claim 12, wherein the secondary electron extraction layer is coated on an entire surface of the secondary electron extraction electrode.

14. The terahertz radiation source of claim 12, wherein the secondary electron extraction layer is coated on an inner surface of the hole of the secondary electron extraction electrode having the shape of the looped-type disk.

15. The terahertz radiation source of claim 10, wherein an insulating layer is interposed between the cathode and the gate electrode, and between the gate electrode and the secondary electron extraction electrode.

16. The terahertz radiation source of claim 11, wherein an insulating layer is interposed between the cathode and the gate electrode, between the gate and the secondary electron extraction electrode, and between adjacent ones of the plurality of secondary electron extraction electrodes.

17. The terahertz radiation source of claim 10, wherein voltages applied to the cathode, the gate electrode, the secondary electron extraction electrode and the anode are respectively denoted by Vc, Vg, Ve and Va, and an equation $Vc<Vg<Ve<Va$ is satisfied.

18. The terahertz radiation source of claim 11, wherein a voltage applied to each of the plurality of secondary electron extraction electrodes, which are consecutively arranged, increases along a proceeding direction of the electron beams.

19. The terahertz radiation source of claim 10, wherein the terahertz circuit is any one of a smith-purcell radiation structure, a photonic band gap crystal structure, a cavity resonator structure and a waveguide structure.

* * * * *